US008839914B2

(12) United States Patent
Iwata et al.

(10) Patent No.: US 8,839,914 B2
(45) Date of Patent: Sep. 23, 2014

(54) ELEVATOR SYSTEM INCLUDING FIRE EVACUATION PRIORITY

(75) Inventors: Masafumi Iwata, Tokyo (JP); Masahiko Konishi, Tokyo (JP); Kiyoji Kawai, Tokyo (JP); Toshiyuki Kodera, Tokyo (JP); Akihisa Miyajima, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 627 days.

(21) Appl. No.: 13/144,088

(22) PCT Filed: Jan. 18, 2010

(86) PCT No.: PCT/JP2010/050483

§ 371 (c)(1),
(2), (4) Date: Jul. 12, 2011

(87) PCT Pub. No.: WO2010/082650

PCT Pub. Date: Jul. 22, 2010

(65) Prior Publication Data

US 2011/0272221 A1 Nov. 10, 2011

(30) Foreign Application Priority Data

Jan. 19, 2009 (JP) ..... 2009 008456

(51) Int. Cl.
*B66B 1/20* (2006.01)
*B66B 5/02* (2006.01)

(52) U.S. Cl.
CPC ..... *B66B 5/021* (2013.01); *B66B 5/024* (2013.01)
USPC ..... 187/384; 187/387

(58) Field of Classification Search
USPC ..... 187/247, 248, 313, 316, 317, 380–389, 187/391–393, 396
See application file for complete search history.

(56) References Cited

U.S. PATENT DOCUMENTS 5,979,607 A 11/1999 Allen
7,182,174 B2 * 2/2007 Parrini et al. ..... 182/18

(Continued)

FOREIGN PATENT DOCUMENTS

CN 101061052 A 10/2007
EP 1 068 142 B1 11/2003

(Continued)

OTHER PUBLICATIONS

Korean Office Action issued Sep. 25, 2012, in Korea Patent Application No. 10-2011-7016737 (with Partial English translation).

(Continued)

*Primary Examiner* — Anthony Salata
(74) *Attorney, Agent, or Firm* — Oblon, Spivak, McClelland, Maier & Neustadt, L.L.P.

(57) ABSTRACT

An elevator system capable of an efficient evacuation using an elevator in case of a fire, and capable of confirming an evacuee remaining status in a case that an evacuation operation using the elevator is discontinued. An evacuation-call response-order setting section sets a priority order of a response to an evacuation special call registered in an evacuation special call registration section, based on fire occurrence information received by a fire situation reception section. A responding floor is selected based on the priority order. The evacuation operation running section controls an operation of the elevator so as to direct a car to the responding floor selected in this manner. In a case that the evacuation operation availability determination section determines that the evacuation operation is not available, the evacuation operation terminating section causes an evacuation special call remaining floor display section to display a remaining evacuation special call registration floor.

16 Claims, 9 Drawing Sheets

(56) References Cited

U.S. PATENT DOCUMENTS

| | | | | |
|---|---|---|---|---|
| 7,210,564 | B2 | 5/2007 | Kawai | |
| 7,413,059 | B2 * | 8/2008 | Kawai | 187/384 |
| 7,461,723 | B2 * | 12/2008 | Kawai | 187/313 |
| 7,588,126 | B2 * | 9/2009 | Siikonen et al. | 187/384 |
| 7,594,564 | B2 * | 9/2009 | Siikonen et al. | 187/384 |
| 7,621,378 | B2 | 11/2009 | Kawai | |
| 7,637,354 | B2 * | 12/2009 | Kawai | 187/313 |
| 7,677,363 | B2 * | 3/2010 | Kawai | 187/387 |
| 7,849,973 | B2 * | 12/2010 | Hikita et al. | 187/384 |
| 7,905,329 | B2 * | 3/2011 | Urata | 187/384 |
| 7,926,621 | B2 * | 4/2011 | Kawai et al. | 187/387 |
| 8,109,368 | B2 * | 2/2012 | Manabe | 187/384 |
| 8,245,819 | B2 * | 8/2012 | Hikita et al. | 187/384 |
| 8,251,185 | B2 * | 8/2012 | Manabe | 187/384 |
| 2008/0067006 | A1 | 3/2008 | Hikita et al. | |
| 2009/0038892 | A1 | 2/2009 | Kawai et al. | |
| 2009/0255761 | A1 | 10/2009 | Kawai | |
| 2011/0128159 | A1 | 6/2011 | Hikita et al. | |

FOREIGN PATENT DOCUMENTS

| | | | |
|---|---|---|---|
| EP | 1 975 108 | A1 | 10/2008 |
| JP | 50-106366 | | 8/1975 |
| JP | 02 204284 | | 8/1990 |
| JP | 05 8954 | | 1/1993 |
| JP | 5-8954 | A | 1/1993 |
| JP | 2002 509850 | | 4/2002 |
| JP | 2002-509850 | | 4/2002 |
| JP | 2003-276964 | | 10/2003 |
| JP | 2005-104631 | | 4/2005 |
| JP | 2005-187162 | | 7/2005 |
| JP | 2006-16098 | A | 1/2006 |
| JP | 2006-193296 | | 7/2006 |
| JP | 2007 091379 | | 4/2007 |
| JP | 2008 308309 | | 12/2008 |
| JP | 2008-308309 | | 12/2008 |
| WO | WO 2004/101418 | A1 | 11/2004 |
| WO | WO 2006/085386 | A1 | 8/2006 |
| WO | 2007 032083 | | 3/2007 |
| WO | 2007 083364 | | 7/2007 |
| WO | 2007 083383 | | 7/2007 |

OTHER PUBLICATIONS

German Office Action issued Sep. 17, 2012 in Patent Application No. 11 2010 000 722.5 with Partial English Translation.

International Preliminary Report on Patentability and Written Opinion of the International Searching Authority issued Aug. 16, 2011, in Patent Application No. PCT/JP2010/050483 (with English-lanuage translation).

International Search Report issued Mar. 16, 2010 in PCT/JP10/050483 filed Jan. 18, 2010.

Japanese Office Action issued Feb. 26, 2013 in Patent Application No. 2010-546665 with Partial English Translation.

Office Action issued Nov. 22, 2012 in Chinese Patent Application No. 201080004781.1 (with English translation).

* cited by examiner

F I G . 6

| PRIORITY ORDER | NAME OF PRIORITY ZONE | FLOOR BELONGING TO ZONE |
|---|---|---|
| 1 | FIRE FLOOR ZONE | FIRE OCCURRING FLOOR |
| 2 | IMMEDIATELY-ABOVE-FIRE FLOOR ZONE | ONE FLOOR ABOVE FIRE OCCURRING FLOOR |
| 3 | ABOVE-FIRE FLOOR ZONE | FROM TWO FLOORS ABOVE FIRE OCCURRING FLOOR TO TOP FLOOR |
| 4 | BELOW-FIRE FLOOR ZONE | FROM ONE FLOOR ABOVE EVACUATION FLOOR TO ONE FLOOR BELOW FIRE OCCURRING FLOOR |

ELEVATOR SYSTEM INCLUDING FIRE EVACUATION PRIORITY

TECHNICAL FIELD

The present invention relates to an elevator system for controlling an elevator, and more specifically to an elevator system suitably used for fire evacuation.

BACKGROUND ART

An increase in the height of a building such as an apartment and an office building involves a problem of a method for fire-evacuation of residents of the building and particularly for vulnerable people including elderly people, babies, wheelchair users, and the like. One of the proposed methods for evacuating vulnerable people is to use an elevator equipped in the building as evacuation means. For example, Patent Document 1 and Patent Document 2 disclose techniques of controlling an elevator in case of a fire.

The Patent Document 1 discloses a technique in which a fire occurrence detection section and a building-equipment status detection section are provided, and information thereof is used in determining whether or not an evacuation operation is available, then responding to an evacuation operation hall call registered from an evacuation operation hall call input section.

The Patent Document 2 discloses a technique in which, in an elevator equipment having a plurality of elevators sharing service floors, a fire occurring floor is identified and detected based on the service floors of the elevators, and a fire control operation is performed sequentially from the elevator whose service floors include the fire occurring floor, the elevator whose service floors include floors above the fire occurring floor, and the elevator whose service floors include floors below the fire occurring floor.

PRIOR-ART DOCUMENTS

Patent Documents

Patent Document 1: Japanese Patent Application Laid-Open No. 2005-187162

Patent Document 2: Japanese Patent Application Laid-Open No. 5-8954 (1993)

SUMMARY OF INVENTION

Problems to be Solved by the Invention

In the technique disclosed in the Patent Document 1 mentioned above, whether or not the evacuation operation is available is determined based on a fire occurring situation. Therefore, in some cases, the evacuation using the elevator must be discontinued depending on a status of progress of the fire. If the evacuation using the elevator is discontinued, a problem arises that a part of residents cannot be evacuated to a safe floor.

In an elevator operation method disclosed in the Patent Document 2 mentioned above, the fire control operation is performed sequentially from the elevator whose service floors include the fire floor, the elevator whose service floors include the above-fire floors, and the elevator whose service floors include the below-fire floors. However, in a case of the fire control operation, there is a problem that the evacuation operation cannot be continued because the elevator takes a pause at the evacuation floor after arriving at the evacuation floor.

Additionally, the order of the fire control operation is determined based on the relationship between the fire floor and the service floors of the elevators. In other words, the order of an elevator response is not determined based on the relationship between the fire floor and a floor where vulnerable people needing elevator evacuation are waiting for the elevator. This causes a problem that prior to completion of evacuation of the vulnerable people staying on the fire floor, the floor immediately above the fire floor, or floors above and relatively close to the fire floor, evacuees on the other floors may be rescued.

Moreover, even though evacuees on the fire floor and the floor immediately above the fire floor once leave the elevator hall, then evacuees may gather to the elevator hall in order to evacuate using the elevator. The Patent Document 2 does not disclose any priority order of a response in such a case.

Furthermore, in a case where the evacuation using the elevator is discontinued, a rescue operation performed by firefighters is needed. Here, a problem arises that rescue workers cannot easily recognize where vulnerable people who need assistance are left.

An object of the present invention is to provide an elevator system allowing efficient evacuation using an elevator in case of a fire.

Another object of the present invention is to provide an elevator system allowing recognition of an evacuee remaining status in a case where an evacuation operation using the elevator is discontinued.

Means for Solving the Problems

An elevator system according to the present invention is an elevator system controlling an elevator so as to perform an evacuation operation for evacuating a user in case of a fire, the elevator system including: an evacuation-call response-order setting section for: setting, based on fire occurrence information including a site of occurrence of the fire, a priority order of a response to an evacuation special call that is a special hall call for the evacuation operation registered by the user; and selecting, based on the priority order, a call responding floor to be responded to from registration floors in which the evacuation special call is registered; and an evacuation operation running section for controlling an operation of the elevator so as to direct the elevator to the call responding floor selected by the evacuation-call response-order setting section.

An elevator system according to the present invention is an elevator system controlling an elevator so as to perform an evacuation operation for evacuating a user in case of a fire, the elevator system including: an evacuation operation availability determination section for determining the availability of the evacuation operation based on fire occurrence information including a site of occurrence of the fire; and a remaining floor output section for, in a case where the evacuation operation availability determination section determines that the evacuation operation is not available, outputting remaining floor information indicating a remaining registration floor among registration floors in which an evacuation special call that is a special hall call for the evacuation operation is registered by the user.

Effects of the Invention

In the elevator system according to the present invention, the evacuation-call response-order setting section sets the priority order of the response to the evacuation special call registered by the user, based on the fire occurrence information including the site of occurrence of the fire. A call responding floor to be responded to is selected based on the priority order of the response thus set, and the evacuation operation running section controls the operation of the elevator so as to direct the elevator to the selected call responding floor. This enables an efficient evacuation with a limited number of elevators. For example, the priority order of the response may be set in accordance with a distance from the site of occurrence of the fire and the degree of risk, and the responding floor may be selected based on this priority order, thereby users needing an urgent evacuation using the elevator can be evacuated by the elevator before the progress of fire makes the evacuation with the elevator difficult. Additionally, it can be confirmed that no evacuee is left in a zone in which there is no remaining evacuation special call.

In the elevator system according to the present invention, the evacuation operation availability determination section determines the availability of the evacuation operation based on the fire occurrence information including the site of occurrence of the fire. In a case where the evacuation operation availability determination section determines that the evacuation operation is not available, the remaining floor output section outputs the remaining floor information indicating the remaining evacuation special call registration floor. Thereby, if the evacuation operation cannot be continued and is terminated, in other words, if the evacuation operation is discontinued, a remaining status of the evacuation special call can be confirmed, so that an evacuee remaining status can be confirmed.

BRIEF DESCRIPTION OF THE DRAWINGS

FIG. 6 is a diagram showing an example of priority zones used in a process shown in the flowchart of FIG. 5.

EMBODIMENT FOR CARRYING OUT THE INVENTION

Embodiment 1

Figure 1:
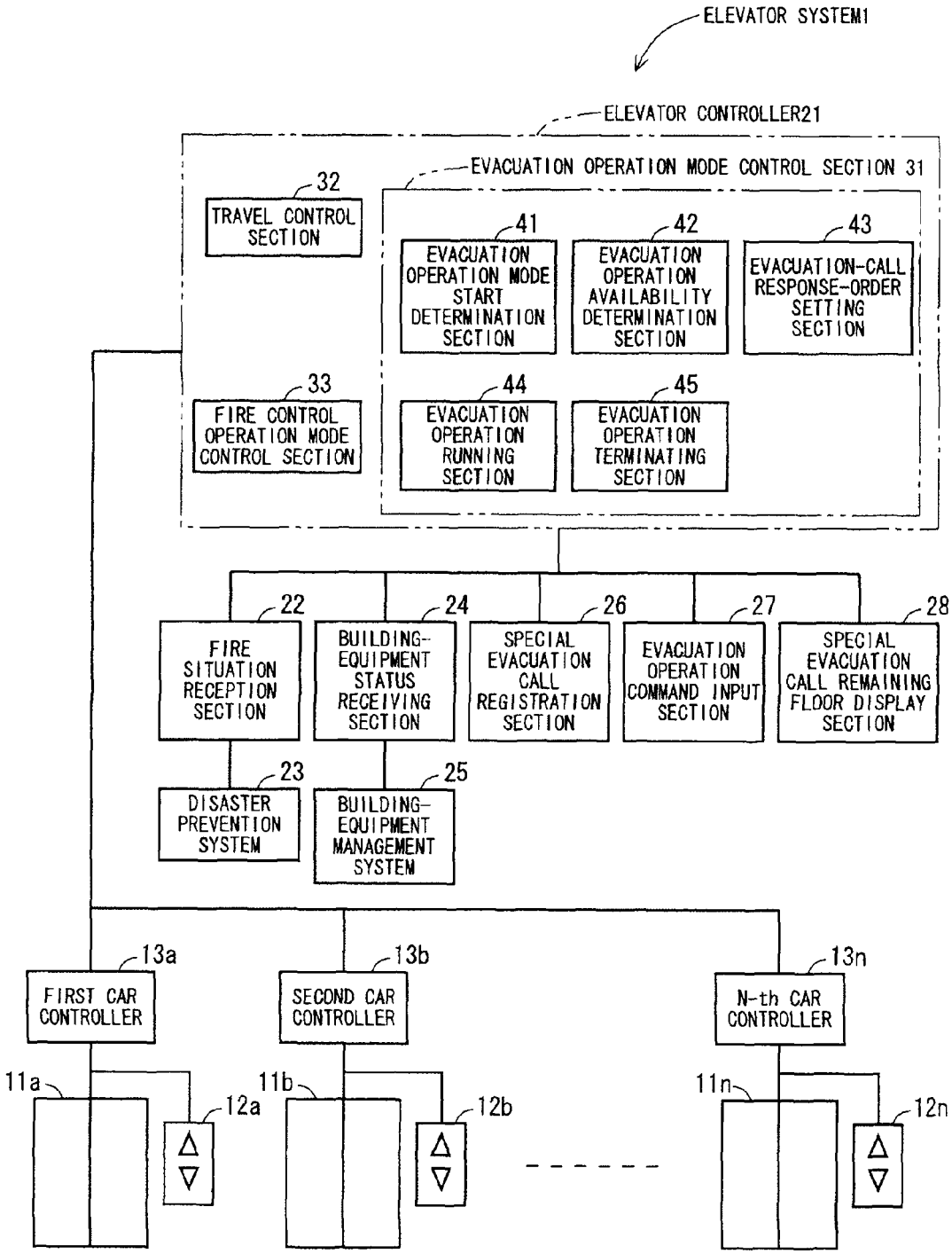
FIG. 1 is a block diagram showing a configuration of an elevator system 1 according to an embodiment 1 of the present invention.

FIG. 1 is a block diagram showing a configuration of an elevator system 1 according to an embodiment of the present invention. The elevator system 1 determines an appropriate evacuation method based on information indicating a site of occurrence of fire or smoke. Based on the determined appropriate evacuation method, the elevator system 1 controls the travel of an elevator equipped in a building, and performs evacuation guidance. The elevator system 1 is configured to control the elevator so as to respond to only an evacuation special call operated by an evacuee without responding to a normal hall call during an evacuation operation.

The elevator system 1 includes N (N is an integer value equal to or greater than 1) cars 11*a* to 11*n*, hall call buttons 12*a* to 12*n*, N car controllers which are more specifically first to N-th car controllers 13*a* to 13*n*, an elevator controller 21, a fire situation reception section 22, a building-equipment status receiving section 24, an evacuation special call registration section 26, an evacuation operation command input section 27, and an evacuation special call remaining floor display section 28. The hall call buttons 12*a* to 12*n* correspond to the cars 11*a* to 11*n*, respectively, and the number of hall call buttons 12*a* to 12*n* is equal to the number of cars 11*a* to 11*n*. That is, N hall call buttons 12*a* to 12*n* are provided to respective floors.

The elevator controller 21 includes an evacuation operation mode control section 31, a travel control section 32, and a fire control operation mode control section 33. The evacuation operation mode control section 31 includes an evacuation operation mode start determination section 41, an evacuation operation availability determination section 42, an evacuation-call response-order setting section 43, an evacuation operation running section 44, and an evacuation operation terminating section 45. In the following description, the subscripts "a" to "n" of the reference numeral "11" are omitted to represent any of the cars, the subscripts "a" to "n" of the reference numeral "12" are omitted to represent any of the hall call buttons, and the words "first" to "N-th" and the subscripts "a" to "n" of the reference numeral "13" are omitted to represent any of the car controllers.

Each of the hall call buttons 12*a* to 12*n* is operated by an user in order to call each of the cars 11*a* to 11*n* at the hall. In this embodiment, the hall call buttons 12 correspond to the cars 11, respectively, and the number of the hall call buttons 12 is equal to the number of cars 11. That is, N hall call buttons 12 are provided to the respective floors. However, it may be also acceptable that one hall call button 12 corresponds to a plurality of cars 11.

The car controllers 13*a* to 13*n* control the corresponding cars 11*a* to 11*n*, respectively. More specifically, the car controller 13 controls a drive system, a door mechanism, a lighting device, and an air-conditioner of the car 11, and receives an input signal concerning a display on an in-car operation panel and an input signal given from an operation button. The car controller 13 also receives an input signal given from the hall call button 12.

The elevator includes one car 11, and the car controller 13, the hall call button 12, the drive system, the door mechanism, the lighting device, the air-conditioner, and the in-car operation panel that correspond to the car 11. In this embodiment, the elevator system 1 includes N elevators.

The elevator controller 21 is capable of mutual communication with the car controllers 13, and controls all the elevators, and more specifically controls travel operations of all the cars 11. Although in this embodiment, the car controller 13 and the elevator controller 21 are separated from each other, the function of the elevator controller 21 may be installed in any one of the car controllers 13 or may be divided and installed in a plurality of the car controllers 13, to integrate the elevator controller 21 and the car controller 13 with each other.

The fire situation reception section 22 is capable of mutual communication with a disaster prevention system 23. The disaster prevention system 23 has a fire detector and a fire alarm apparatus, and transmits to the fire situation reception section 22 information (hereinafter referred to as "fire occurrence information") indicating a detection status of the fire detector and an alarming status of the fire alarm apparatus. The fire occurrence information includes occurring site information indicating the site of occurrence of fire or smoke. The fire situation reception section 22 receives the fire occurrence information transmitted by the disaster prevention system 23. The fire situation reception section 22 gives the received fire occurrence information to the elevator controller 21, and more specifically to the evacuation operation mode control section 31 and the fire control operation mode control section 33 of the elevator controller 21.

The building-equipment status receiving section 24 is capable of mutual communication with the building-equipment management system 25. The building-equipment status receiving section 24 receives building-equipment status information from the building-equipment management system 25 that manages building equipments. The building-equipment status information indicates a status of building equipments such as a status of a power system in the building and a power system related to the elevator, a status of a water and sewer system, and a running status of fire protection equipments including a fireproof door, a sprinkler, and the like. The building-equipment management system 25 transmits the building-equipment status information to the building-equipment status receiving section 24. The building-equipment management system 25 may be configured as a single system, or may be configured as a plurality of different systems each corresponding to each kind of equipments to be managed or to each of equipments to be managed.

Figure 2:
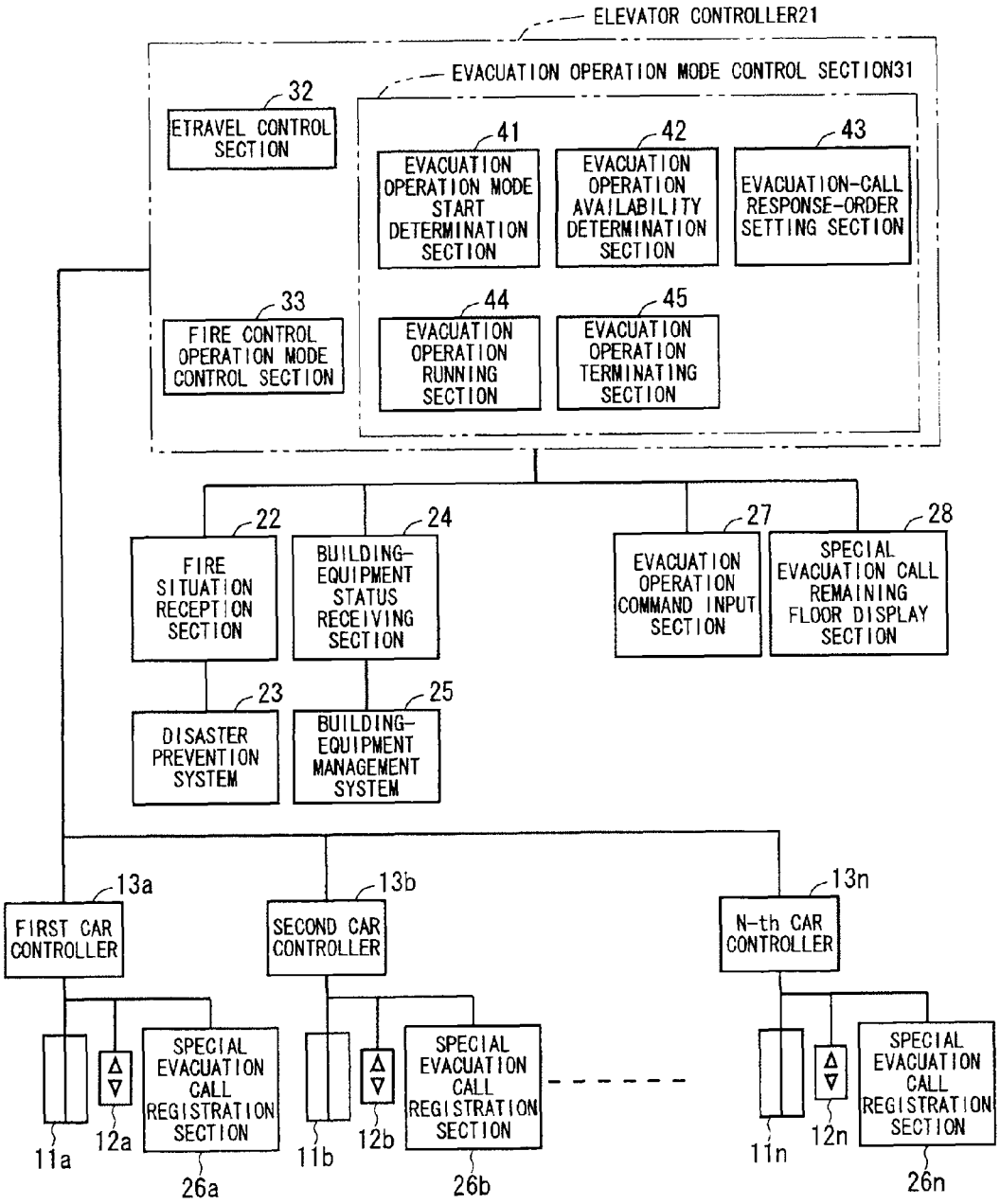
FIG. 2 is a block diagram showing a configuration of an elevator system according to another embodiment of the present invention.

The evacuation special call registration section 26 receives a special hall call for an evacuation operation case, and outputs evacuation special call registration information. The evacuation special call registration section 26 may be integrated with a normal hall call button 12, or may be installed as an independent button accessible only to a person permitted in advance. The button accessible only a person permitted in advance may be configured as at least any one of a keyed operation button, an IC (Integrated Circuit) tag reader, a key tag reader, a fingerprint authentication device, a face recognition authentication device, and a remote control. Each of the floors is provided with at least one evacuation special call registration section 26. Instead of the configuration of FIG. 1, as shown in FIG. 2 (FIG. 2 is a block diagram showing an elevator system according to another embodiment), the evacuation special call registration section 26 may be provided to each one of the cars 1 or to each one of the floors (see the reference numerals 26*a*, 26*b*, . . . , 26*n* of FIG. 2). The evacuation special call registration section 26 may be configured as a special button installed in a residence of a person permitted to register the evacuation special call in advance, as a button attached to an intercom device, or the like. A button having a casing, such as an emergency button, may be used so that an unpermitted person can be psychologically inhibited from using the button.

The evacuation special call registration section 26 may be configured to cancel the call when the car 11 arrives at a destination floor similarly to the normal hall call button 12, or configured to maintain a call registration until a call registration cancel operation is performed. Additionally, in another possible configuration, a presence sensor or a camera is provided in the hall and a call is registered only while a human presence is detected, or in still another possible configuration, a call registration is operated by the user and only a cancellation thereof is performed by a sensor.

The evacuation operation command input section 27 is operated by a building manager, a firefighter, or the like, in order to input an evacuation operation running command. When receiving the evacuation operation running command, the evacuation operation command input section 27 gives a signal (hereinafter referred to as a "evacuation operation command signal") indicating the evacuation operation running command to the evacuation operation availability determination section 42 of the evacuation operation mode control section 31 of the elevator controller 21. The evacuation operation command input section 27 may be provided in a fire department, an elevator management company, a security company, or the like, so that remote processing can be performed.

In a case where the evacuation operation is terminated in the middle of evacuation because of progress of the fire, the evacuation special call remaining floor display section 28 displays the remaining status of the evacuation special call registration, for example, displays the number of floors where the evacuation special call registration remains. Thereby, in a subsequent rescue operation, the evacuation special call registration can be effectively utilized for determining the presence of remaining evacuees.

In case of a fire, the evacuation operation mode control section 31 makes a determination of a start of an evacuation operation mode, a determination of the availability of the evacuation operation running, and a determination of a traveling method during the evacuation operation; and outputs a travel command signal to the travel control section 32. The evacuation operation mode represents for a manner of operating the elevator in a case where the elevator is used as evacuation means when a fire or the like occurs in a building.

The travel control section 32 performs a travel control on the car controller 13. The travel control includes allocation of the hall call, a stand-by operation, a sending operation, a stop floor restriction, and the like. During the evacuation operation mode, the travel control section 32 performs the travel control in accordance with the output of the evacuation operation mode control section 31.

The fire control operation mode control section 33 controls operations for terminating a normal operation mode, and starting and terminating the fire control operation mode. The normal operation mode represents for an operation manner in which the car 11 is moved to a floor where a user is waiting in response to a hall call designated by the user of the elevator staying in the hall, to embark the user, then the car 11 is moved to a destination floor designated by the user, and then the user is carried to the destination floor. The fire control operation mode represents for an operation manner in which, in case of a fire, the car 11 of the elevator is stopped at the nearest floor and then directly moved to an evacuation floor, and then a door is opened to evacuate passengers in the car 11. The evacuation floor in the fire control operation mode may be the same as or different from the evacuation floor in the evacuation operation mode.

When the normal operation mode terminates, the fire control operation mode control section 33 gives a signal (hereinafter referred to as a "normal operation mode terminating signal") indicating a termination of the normal operation mode, to the evacuation operation mode start determination section 41 of the evacuation operation mode control section 31 of the elevator controller 21. When the fire control operation mode is started, the fire control operation mode control section 33 gives a signal (hereinafter referred to as a "fire control operation mode starting signal") indicating a start of the fire control operation mode, to the evacuation operation mode start determination section 41 of the evacuation operation mode control section 31 of the elevator controller 21.

When the fire control operation mode is started, in case of a fire, the fire control operation mode control section 33 outputs the travel command signal to the travel control section 32 such that the car 11 can be stopped at the nearest floor once, and then moved to the evacuation floor set in advance, to take a pause. In the fire control operation mode, the travel control section 32 performs the travel control in accordance with the travel command signal outputted from the fire control operation mode control section 31. When the fire control running operation is completed, the fire control operation mode control section 33 terminates the fire control operation mode, and gives a signal (hereinafter referred to as a "fire control operation mode terminating signal") indicating a termination of the fire control operation mode, to the evacuation operation mode start determination section 41 of the evacuation operation mode control section 31 of the elevator controller 21.

The evacuation operation mode start determination section 41 determines whether or not a fire is occurring based on the fire occurrence information received by the fire situation reception section 22, and determines the termination of the normal operation mode and the termination of the fire control operation mode.

The evacuation operation availability determination section 42 determines the availability of the evacuation operation, based on the fire occurrence information received by the fire situation reception section 22, the building-equipment status information received by the building-equipment status receiving section 24, the evacuation special call registration information outputted from the evacuation special call registration section 26, and the evacuation operation command outputted from the evacuation operation command input section 27. In a case where it is determined that the evacuation operation is available as a result of the determination of the availability of the evacuation operation, the evacuation operation availability determination section 42 outputs an evacuation operation allowing signal. In a case where it is determined that the evacuation operation is not available, the evacuation operation availability determination section 42 outputs an evacuation operation unallowing signal.

The evacuation-call response-order setting section 43 sets the order of the response to the evacuation special call. The evacuation operation running section 44 performs an evacuation operation running process. The evacuation operation terminating section 45 performs an evacuation operation terminating process.

Figure 3:
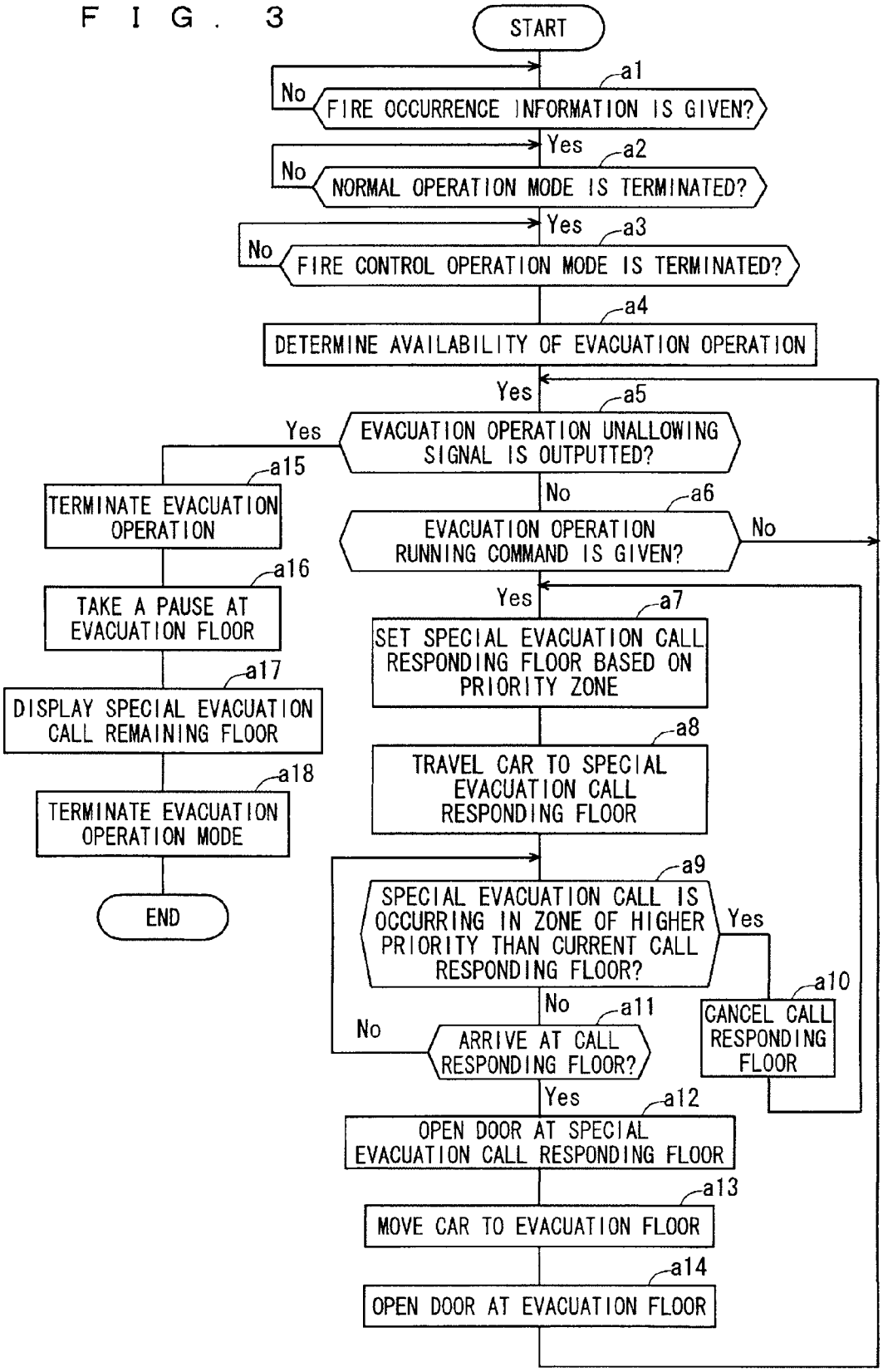
FIG. 3 is a flowchart showing process steps of an operation of an evacuation operation mode control section 31.

FIG. 3 is a flowchart showing process steps of an operation of the evacuation operation mode control section 31. The steps in the flowchart shown in FIG. 3 are performed by the evacuation operation mode start determination section 41, the evacuation operation availability determination section 42, the evacuation-call response-order setting section 43, the evacuation operation running section 44, and the evacuation operation terminating section 45 of the evacuation operation mode control section 31. The process of the flowchart shown in FIG. 3 is started when, for example, a power source for supplying power to each section of the elevator system 1 is turned on or an evacuation operation activation switch provided in the elevator controller 21 is turned on (ON). Then, processing moves to step a1.

In step a1, the evacuation operation mode start determination section 41 determines whether or not a fire is occurring. To be more specific, the evacuation operation mode start determination section 41 determines whether or not the fire occurrence information is given from the fire situation reception section 22. In a case where the fire occurrence information is given, the evacuation operation mode start determination section 41 determines that a fire is occurring, and the processing moves to step a2. In a case where the fire occurrence information is not given, the evacuation operation mode start determination section 41 determines that a fire is not occurring, and waits until the fire occurrence information is given from the fire situation reception section 22.

In step a2, the evacuation operation mode start determination section 41 determines whether or not the normal operation mode is terminated. In an exemplary process of the determination, the evacuation operation mode start determination section 41 determines whether or not the normal operation mode terminating signal is given from the fire control operation mode control section 33, and in a case where the normal operation mode terminating signal is given, the evacuation operation mode start determination section 41 determines that the normal operation mode is terminated and the processing moves to step a3 while in a case where the normal operation mode terminating signal is not given, the evacuation operation mode start determination section 41 determines that the normal operation mode is not terminated and waits until the normal operation mode terminating signal is given from the fire control operation mode control section 33. This example of the operation is merely illustrative, and in the present invention, a section that gives the normal operation mode terminating signal is not limited to the fire control operation mode control section 33.

In step a3, the evacuation operation mode start determination section 41 determines whether or not the fire control operation mode is terminated. More specifically, the evacuation operation mode start determination section 41 determines whether or not the fire control operation mode is terminated based on whether or not the fire control operation mode terminating signal is received after the reception of the fire control operation mode starting signal given from the fire control operation mode control section 33.

In a case where the fire control operation mode terminating signal is received, the evacuation operation mode start determination section 41 determines that the fire control operation mode is terminated, and the processing moves to step a4. In a case where the fire control operation mode terminating signal is not received, the evacuation operation mode start determination section 41 determines that the fire control operation mode is not terminated, in other words, that the fire control running operation is currently being performed, and waits until the fire control operation mode terminating signal is received. That is, the evacuation operation mode start determination section 41 waits until the fire control operation process of the fire control operation mode control section 33 is completed and all the cars 11 take a pause at the evacuation floor.

In step a4, the evacuation operation availability determination section 42 determines the availability of the evacuation operation. More specifically, the evacuation operation availability determination section 42 determines the availability of the evacuation operation based on the fire occurrence information received by the fire situation reception section 22, the building-equipment status information received by the building-equipment status receiving section 24, the evacuation special call registration information outputted from the evacuation special call registration section 26, and the evacuation operation command outputted from the evacuation operation command input section 27. The availability of the evacuation operation is determined in accordance with process steps of a flowchart shown in FIG. 4 which will be described later. As a result of the determination of the availability of the evacuation operation, the evacuation operation availability determination section 42 outputs the evacuation operation allowing signal indicating that the evacuation operation is available or the evacuation operation unallowing signal indicating that the evacuation operation is not available. After the processing of step a4 is completed, the processing moves to step a5.

In step a5, the evacuation operation availability determination section 42 determines whether or not the evacuation operation unallowing signal is outputted. In step a5, in a case where it is determined that the evacuation operation unallowing signal is outputted, the evacuation operation availability determination section 42 determines that the evacuation operation is not available, and the processing moves to step a15, while in a case where it is determined that the evacuation operation unallowing signal is not outputted, that is, that the evacuation operation allowing signal is outputted, the evacuation operation availability determination section 42 determines that the evacuation operation is available, and the processing moves to step a6.

In step a6, the evacuation operation availability determination section 42 determines whether or not the evacuation operation command signal is given from the evacuation operation command input section 27. In a case where the evacuation operation command signal is given, the processing moves to step a7, while in a case where the evacuation operation command signal is not given, the evacuation operation is waited and the processing moves to step a5.

In step a7, the evacuation-call response-order setting section 43 sets an evacuation special call responding floor based on a priority zone. The order of the response to the evacuation special call is set in accordance with process steps of a flowchart shown in FIG. 5 which will be described later. After processing of step a7 is completed, the processing moves to step a8. In step a8, the evacuation operation running section 44 travels the car 11 to the evacuation special call responding floor set in step a7. More specifically, the evacuation operation running section 44 outputs a travel command signal to the travel control section 32 so as to move the car 11 to the evacuation special call responding floor set in step a7, to thereby cause the car 11 to travel to the evacuation special call responding floor. After processing of step a8 is completed, the processing moves to step a9.

In step a9, the evacuation operation running section 44 determines whether or not an evacuation special call to a zone of a higher priority than the current evacuation special call responding floor is occurring. In step a9, in a case where the evacuation operation running section 44 determines that an evacuation special call to a higher-priority zone is occurring, the processing moves to step a10, while in a case where the evacuation operation running section 44 determines that an evacuation special call to a higher-priority zone is not occurring, the processing moves to step a11. In step a10, the evacuation operation running section 44 cancels the current evacuation special call responding floor, and the processing returns to step a7.

In step a11, the evacuation operation running section 44 determines whether or not the car 11 arrives at the call responding floor. In step a11, in a case where the evacuation operation running section 44 determines that the car 11 arrives at the call responding floor, the processing moves to step a12, while in a case where the evacuation operation running section 44 determines that the car 11 does not arrive at the call responding floor, the processing returns to step a9.

In step a12, the evacuation operation running section 44 opens the door at the evacuation special call responding floor and embarks evacuees, and then closes the door and the processing moves to step a13. The closing of the door is performed when a door-close button is operated. The closing of the door may also be performed when a predetermined time period elapses.

In step a13, the evacuation operation running section 44 moves the car 11 to the evacuation floor. More specifically, the evacuation operation running section 44 outputs the travel command signal to the travel control section 32 so as to move the car 11 to the evacuation floor, thereby moving the car 11 to the evacuation floor. When the car 11 arrives at the evacuation floor, the processing moves to step a14. In step a14, the evacuation operation running section 44 opens the door at the evacuation floor, to disembark the evacuees. After the processing of step a14 is completed, the processing returns to step a5.

In this embodiment, as described above, one evacuation special call is responded to at one time, and then the car 11 is traveled to the evacuation floor. However, it may be acceptable to respond to a plurality of evacuation special call responding floors until the car 11 becomes fully occupied. In such a case, as the next floor to be responded to after a first evacuation special call responding floor is responded to, an evacuation special call registration floor that is in the same priority zone as the first evacuation special call responding floor and additionally close to the evacuation floor may be selected.

In step a5, in a case where the evacuation operation availability determination section 42 determines that the evacuation operation unallowing signal is outputted, in other words, that the evacuation operation is not available, and thus the processing moves to step a15; then in step a15, the evacuation operation terminating section 45 terminates the evacuation operation. More specifically, the evacuation operation terminating section 45 outputs the travel command signal to the travel control section 32 so as to cause all the cars 11 of the elevators to arrive at the evacuation floor, and terminates the evacuation operation. After the processing of step a15 is completed, the processing moves to step a16.

In step a16, the evacuation operation terminating section 45 outputs the travel command signal to the travel control section 32 so as to cause the cars 11 having arrived at the evacuation floor to take a pause, so that the cars 11 take a pause at the evacuation floor. After the processing of step a16 is completed, the processing moves to step a17.

In step a17, the evacuation operation terminating section 45 causes the evacuation special call remaining floor display section 28 to display the evacuation special call registration status of an evacuation special call remaining at the time point when the travel command signal for causing the pause is outputted in step a15. That is, the evacuation operation terminating section 45 functions as a remaining floor output section, and outputs remaining floor information indicating a remaining evacuation special call registration floor to the evacuation special call remaining floor display section 28 serving as display means, to display it. The evacuation operation terminating section 45 also terminates a new registration of an evacuation special call performed by the evacuation special call registration section 26. After the processing of step a17 is completed, the processing moves to step a18.

In this embodiment, as described above, the new registration of an evacuation special call is terminated at the time point of step a17. However, it may be also acceptable that the new registration of an evacuation special call is continued, and the contents outputted to the evacuation special call remaining floor display section 28 are updated upon each new registration. Moreover, although in this embodiment, the evacuation special call registration status is displayed on the evacuation special call remaining floor display section 28, it may be also acceptable to provide another system having a function of, for example, transmitting the evacuation special call registration status to the disaster prevention system 23, so that the remaining status of the evacuation special call is displayed by the system.

In step a18, the evacuation operation terminating section 45 terminates the evacuation operation mode. After the processing of step a18 is completed, the evacuation operation mode control section 31 completes all the process steps.

Figure 4:
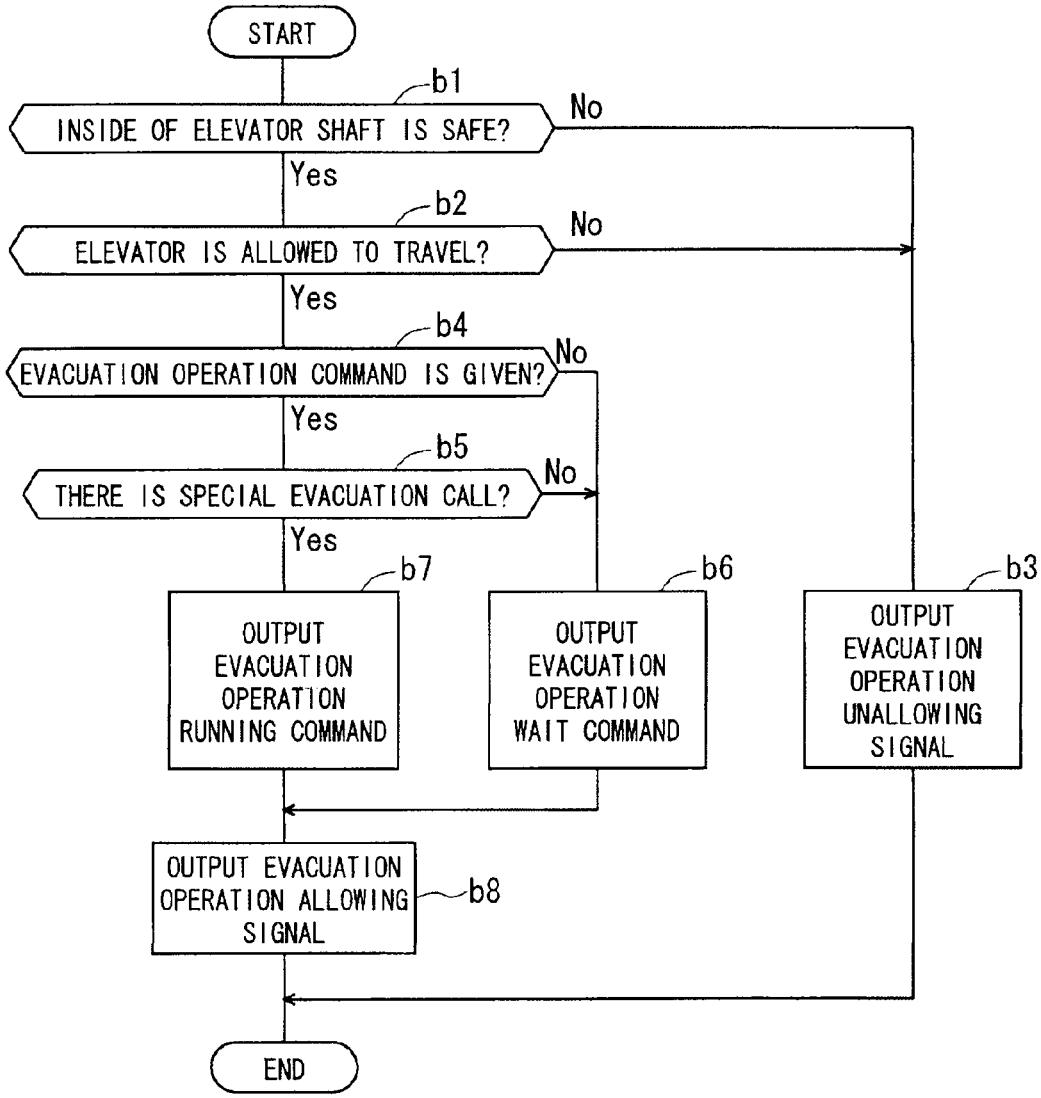
FIG. 4 is a flowchart showing process steps of an operation of an evacuation operation availability determination section 42 in step a4 shown in FIG. 3.

FIG. 4 is a flowchart showing process steps of the operation of the evacuation operation availability determination section 42 performed in step a4 shown in FIG. 3. When the process of the flowchart shown in FIG. 3 shifts from step a3 to step a4, a process of the flowchart shown in FIG. 4 is started, and the processing moves to step b1.

In step b1, the evacuation operation availability determination section 42 determines whether or not the inside of an elevator shaft is safe, based on the occurring site information included in the fire occurrence information given from the fire situation reception section 22. If a fire, a smoke, or the like, is not occurring in the elevator shaft and an area therearound, and in the same fire prevention compartment as the elevator shaft is, the evacuation operation availability determination section 42 determines that the inside of the elevator shaft is safe. In step b1, in a case where it is determined that the inside of the elevator shaft is safe, the processing moves to step b2, and in a case where it is determined that the inside of the elevator shaft is not safe, the processing moves to step b3.

In step b2, the evacuation operation availability determination section 42 determines the availability of travel of the elevator, based on the building-equipment status information indicating the status of the power system, whether or not water leakage to an elevator system occurs, whether or not the fireproof doors of the elevator shaft and the hall are operating, whether or not the sprinkler is operating in the elevator shaft and the hall, and the like. For example, if there is a power supply and no water leakage to the elevator system, the fireproof doors of the hall and the elevator shaft are closed, and the sprinkler is not operating in the elevator shaft and the hall, the evacuation operation availability determination section 42 determines that the elevator is allowed to travel.

In step b2, in a case where it is determined that the elevator is allowed to travel, the processing moves to step b4, while in a case where it is determined that the elevator is not allowed to travel, the processing moves to step b3. In step b3, the evacuation operation availability determination section 42 outputs the evacuation operation unallowing signal, and all the process steps are completed.

In step b4, the evacuation operation availability determination section 42 determines whether or not the evacuation operation command is given from the evacuation operation command input section 27. In step b4, in a case where it is determined that the evacuation operation command is given from the evacuation operation command input section 27, the processing moves to step b5, while in a case where it is determined that the evacuation operation command is not given, the processing moves to step b6.

In step b5, the evacuation operation availability determination section 42 determines whether or not there is a special evacuation hall call registration, based on the evacuation special call registration information given from the evacuation special call registration section 26. In step b5, in a case where it is determined that there is a special evacuation hall call registration, the processing moves to step b7, while in a case where it is determined that there is no special evacuation hall call registration, the processing moves to step b6.

In step b6, the evacuation operation availability determination section 42 outputs an evacuation operation wait command signal for giving a command to wait for an evacuation operation. After the processing of step b6 is completed, the processing moves to step b8. In step b7, the evacuation operation availability determination section 42 outputs an evacuation operation running command signal for giving a command to perform the evacuation operation. After the processing of step b7 is completed, the processing moves to step b8. In step b8, the evacuation operation availability determination section 42 outputs the evacuation operation allowing signal. After the processing of step b8 is completed, all the process steps are completed and the processing moves to step a5 shown in FIG. 3 described above.

Figure 5:
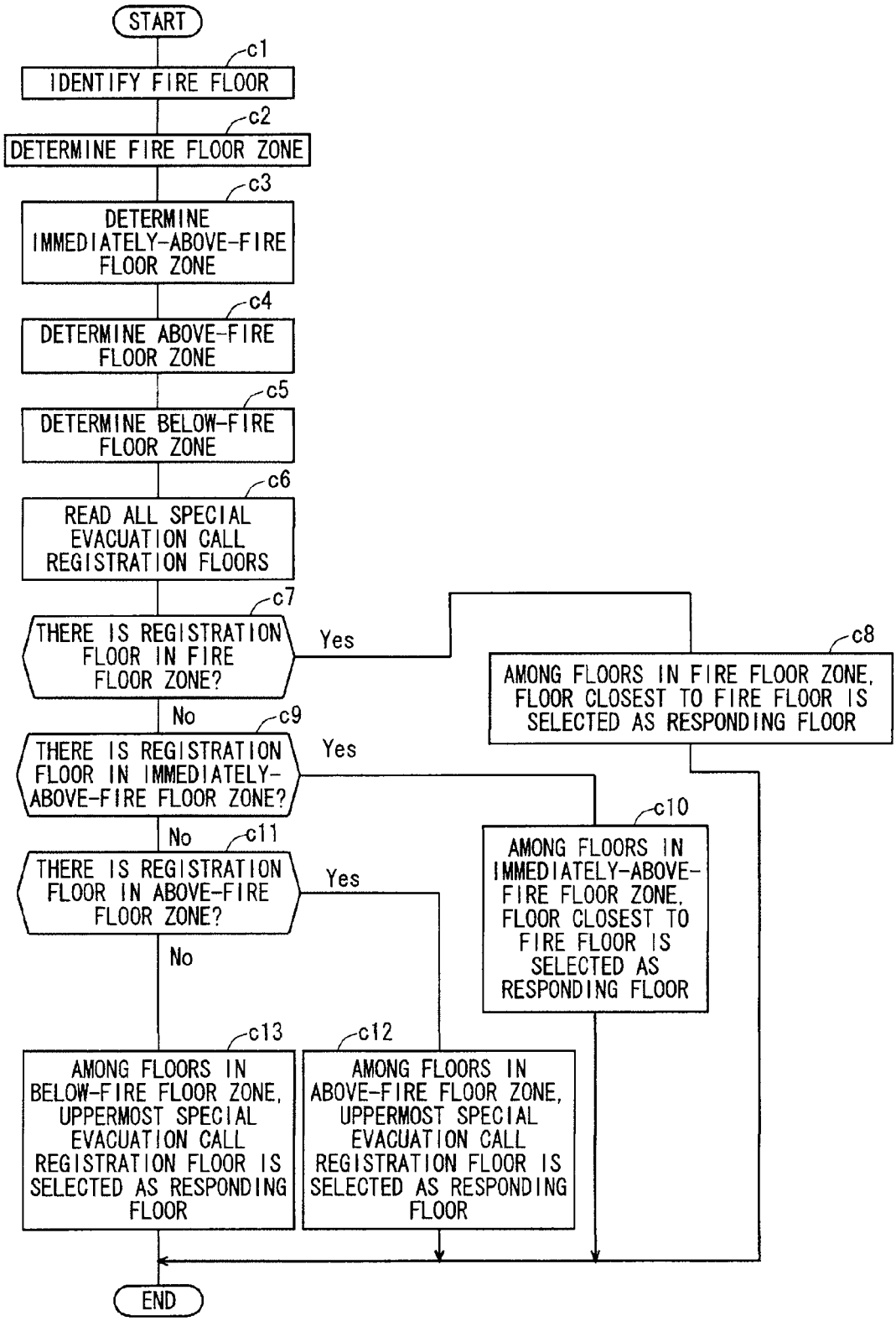
FIG. 5 is a flowchart showing process steps of an operation of an evacuation-call response-order setting section 43 in step a7 shown in FIG. 3.

FIG. 5 is a flowchart showing process steps of the operation of the evacuation-call response-order setting section 43 performed in step a7 shown in FIG. 3. FIG. 6 is a diagram showing an example of priority zones used in a process shown in the flowchart of FIG. 5. FIG. 6 shows the relationship among the priority order, names of the priority zones, and floors belonging to the zones. When the process of the flowchart shown in FIG. 3 described above shifts from step a6 to step a7, a process of the flowchart shown in FIG. 5 is started, and the processing moves to step c1.

In step c1, the evacuation-call response-order setting section 43 identifies a fire floor based on the fire occurrence information received by the fire situation reception section 22, and the processing moves to step c2.

In steps c2 to c5, the evacuation-call response-order setting section 43 determines the priority zone. The priority zone means a floor group used for assignment of the priority in determining the order of the response to the evacuation special call. For example, zone setting as shown in FIG. 6 is made in advance. FIG. 6 shows four zones, namely, a fire floor zone, an immediately-above-fire floor zone, an above-fire floor zone, and a below-fire floor zone. These zones are obtained by classifying all the floors to which the elevator can be moved into a plurality of zones such that at least one of the zones can include a plurality of floors.

The floors belonging to the respective zones are as shown in FIG. 6. That is, the fire floor zone is set to be only the fire occurring floor. The immediately-above-fire floor zone is set to be only the floor immediately above the fire occurring floor. The above-fire floor zone is set to be from two floors above the fire occurring floor to the top floor. The below-fire floor zone is set to be from one floor below the fire occurring floor to one floor above the evacuation floor.

Setting of the priority zones is not limited thereto. For example, it may be also acceptable that: the fire floor zone is set to be floors in an arbitrary range based on the fire occurring floor; the above-fire floor zone is set to be from one floor above the top floor of the fire floor zone to the top floor of the building; and the below-fire floor zone is set to be from one floor below the fire occurring floor to the floor immediately above the evacuation floor. A zone including a plurality of floors may be further divided into smaller zones.

In step c2, the evacuation-call response-order setting section 43 determines a floor belonging to the fire floor zone in accordance with FIG. 6, and the processing moves to step c3. In step c3, the evacuation-call response-order setting section 43 determines a floor belonging to the immediately-above-fire floor zone in the same manner as step c2, and the processing moves to step c4. In step c4, the evacuation-call response-order setting section 43 determines a floor belonging to the above-fire floor zone in the same manner as step c2, and the processing moves to step c5. In step c5, the evacuation-call response-order setting section 43 determines a floor belonging to the below-fire floor zone in the same manner as step c2, and the processing moves to step c6.

In step c6, the evacuation-call response-order setting section 43 reads all of the evacuation special call registration floors. After the processing of step c6 is completed, the processing moves to step c7.

In step c7, the evacuation-call response-order setting section 43 determines whether there is an evacuation special call registration in the fire floor zone. In step c7, in a case where it is determined that there is an evacuation special call registration in the fire floor zone, the processing moves to step c8, while in a case where it is determined that there is no evacuation special call registration in the fire floor zone, the processing moves to step c9.

In step c8, the evacuation-call response-order setting section 43 selects, as a responding floor, the floor closest to the fire occurring floor among the floors in the fire floor zone. In this embodiment, only the fire occurring floor belongs to the fire floor zone. Therefore, the fire occurring floor is selected as the responding floor. After the processing of step c8 is completed, all the process steps are completed.

In step c9, the evacuation-call response-order setting section 43 determines whether or not there is an evacuation special call registration in the immediately-above-fire floor zone. In step c9, in a case where it is determined that there is an evacuation special call registration in the immediately-above-fire floor zone, the processing moves to step c10, while in a case where it is determined that there is no evacuation special call registration in the immediately-above-fire floor zone, the processing moves to step c11.

In step c10, the evacuation-call response-order setting section 43 selects, as a responding floor, the floor closest to the fire occurring floor among the floors in the immediately-above-fire floor zone. In this embodiment, only the floor immediately above the fire occurring floor belongs to the immediately-above-fire floor zone. Therefore, the floor immediately above the fire occurring floor is selected as the responding floor. After the processing of step c10 is completed, all the process steps are completed.

In step c11, the evacuation-call response-order setting section 43 determines whether or not there is an evacuation special call registration in the above-fire floor zone. In step c11, in a case where it is determined that there is an evacuation special call registration in the above-fire floor zone, the processing moves to step c12, while in a case where it is determined that there is no evacuation special call registration in the above-fire floor zone, the processing moves to step c13.

In step c12, the evacuation-call response-order setting section 43 selects, as a responding floor, the uppermost one of the evacuation special call registration floors in the above-fire floor zone. After the processing of step c12 is completed, all the process steps are completed. The order of the response to the above-fire floor zone may not start from the uppermost floor, but the responding floor may be selected such that the floor closest to the fire floor can firstly make a response.

In step c13, the evacuation-call response-order setting section 43 selects, as a responding floor, the evacuation special call registration floor located uppermost in the below-fire floor zone. After the processing of step c13 is completed, all the process steps are completed.

As described above, in the elevator controller 21 according to this embodiment, the priority order of the response to the evacuation special call registered by the user is set by the evacuation-call response-order setting section 43, based on the fire occurrence information including the site of occurrence of the fire. The call responding floor to be responded to is selected based on the priority order of the response that has been set. The evacuation operation running section 44 controls the operation of the elevator so as to direct the elevator to the selected call responding floor. This enables an efficient evacuation with a limited number of elevators.

Therefore, for example, the priority order of the response is set in accordance with a distance from the fire occurring site and the degree of risk, and the responding floor is selected based on this priority order, thereby users needing an urgent evacuation using the elevator can be evacuated by the elevator before the progress of fire makes the evacuation with the elevator difficult. Additionally, it can be confirmed that no evacuee is left in a zone in which there is no remaining evacuation special call.

In this embodiment, moreover, the priority order of the response to the evacuation special call is set on a zone basis as shown in FIG. 6. Therefore, in a case where the evacuation operation of the elevator cannot be continued in the middle of the operation, the floors in which evacuees are left can be grouped such that physically close floors belong to the same group. This can reduce the burden of the rescue operation performed after the evacuation using the elevator cannot be continued.

In this embodiment, as shown in FIG. 6, the highest-priority zone is the fire floor zone including the fire occurring floor. Therefore, users in the fire occurring floor can be evacuated firstly. Thus, the number of persons left in the fire occurring floor can be made as small as possible.

In this embodiment, as shown in FIG. 6, the second highest-priority zone is the immediately-above-fire floor zone including the floor immediately above the fire occurring floor. Therefore, users in the floor immediately above the fire occurring floor can be evacuated subsequently to the users in the fire occurring floor. Thus, the number of persons left in the floors near the fire occurring floor can be made as small as possible.

In this embodiment, as shown in FIG. 6, the fire floor zone, the immediately-above-fire floor zone, and the above-fire floor zone, to which the fire occurring floor and the floors above the fire occurring floor belong, are given a higher priority than the below-fire floor zone to which the floors below the fire occurring floor belong. That is, the fire occurring floor and the floor above the fire occurring floor are given a higher priority than the floors below the fire occurring floor. Since the responding floor is selected in accordance with such a priority order, the evacuation of users can be started from the fire occurring floor and the floors above the fire occurring floor in which the progress of fire is expected to occur. Thus, the number of persons left in the fire occurring floor and the floors near the fire occurring floor can be made as small as possible.

In this embodiment, in step a11 of the flowchart shown in FIG. 3 described above, whether or not there is an evacuation special call in a priority zone given a higher priority than the current evacuation special call responding floor is determined in step a9, prior to the determination of whether or not the elevator which more specifically is the car 11 of the elevator arrives at the call responding floor. That is, whether or not an evacuation special call having a higher priority than the evacuation special call registered in the call responding floor selected by the evacuation-call response-order setting section 43 is newly registered is determined, before the elevator arrives at the call responding floor.

In step a9, in a case where it is determined that there is an evacuation special call in a priority zone of a higher priority than the current evacuation special call responding floor, in other words, that an evacuation special call of a higher priority than the evacuation special call of the current evacuation special call responding floor is newly registered; in step a10, the current evacuation special call responding floor is cancelled and in step a7, the evacuation special call responding floor is set again.

The evacuation special call responding floor set at this time is the floor in which registered is the evacuation special call that has been determined, in step a9, to be occurring in a priority zone given a higher priority than the current evacuation special call responding floor. That is, the call responding floor is changed to a floor in which an evacuation special call is newly registered. Thus, even while the number of evacuation special call registrations is increasing, a high-priority evacuation special call can be responded to as soon as possible.

In this embodiment, in a case where the evacuation operation availability determination section 42 determines that the evacuation operation is not available, the evacuation operation terminating section 45 serving as the remaining floor output section outputs the remaining floor information indicating a remaining evacuation special call registration floor. Thereby, in a case where the evacuation operation cannot be continued and is terminated, in other words, in a case where the evacuation operation is discontinued, the remaining status of the evacuation special call can be confirmed, so that an evacuee remaining status can be confirmed.

In this embodiment, the remaining evacuation special call registration floor is outputted and displayed by the evacuation special call remaining floor display section 28. Thereby, the remaining status of the evacuation special call can be visually confirmed, and therefore the evacuee remaining status can be easily confirmed.

As described above, in this embodiment, in a case where the evacuation operation cannot be continued and is terminated, the evacuation operation terminating section 45 outputs the remaining evacuation special call registration floor to the display means serving as output means, and more specifically to the evacuation special call remaining floor display section 28, so that the remaining evacuation special call registration floor is displayed. The output means is not limited to the display means, but may be other output means such as transmission means.

In a case where the transmission means is adopted as the output means, the transmission means is configured to be communicable with another system such as the building-equipment management system 25. The remaining floor information indicating the remaining evacuation special call registration floor is given from the evacuation operation terminating section 45 to the transmission means. If the evacuation operation cannot be continued and is terminated, the remaining floor information is given to the transmission means and transmitted to another system.

This enables the remaining status of the evacuation special call to be confirmed through another system. Therefore, the evacuee remaining status can be confirmed through a device different from the elevator controller 21, such as an elevator monitoring system, the disaster prevention system 23, or the building-equipment management system 25, to support the rescue operation performed by private firefighters or public firefighters. Transmission to a system installed in another place is also possible. Therefore, the evacuee remaining status can be confirmed in the place where the system is installed, for example, in a place distant from the fire occurring site such as in the fire department, the elevator management company, or the security company. This can avoid confusion in the fire occurring site, and allows the rescue operation for the remaining evacuees to be smoothly performed.

Embodiment 2

Figure 7:
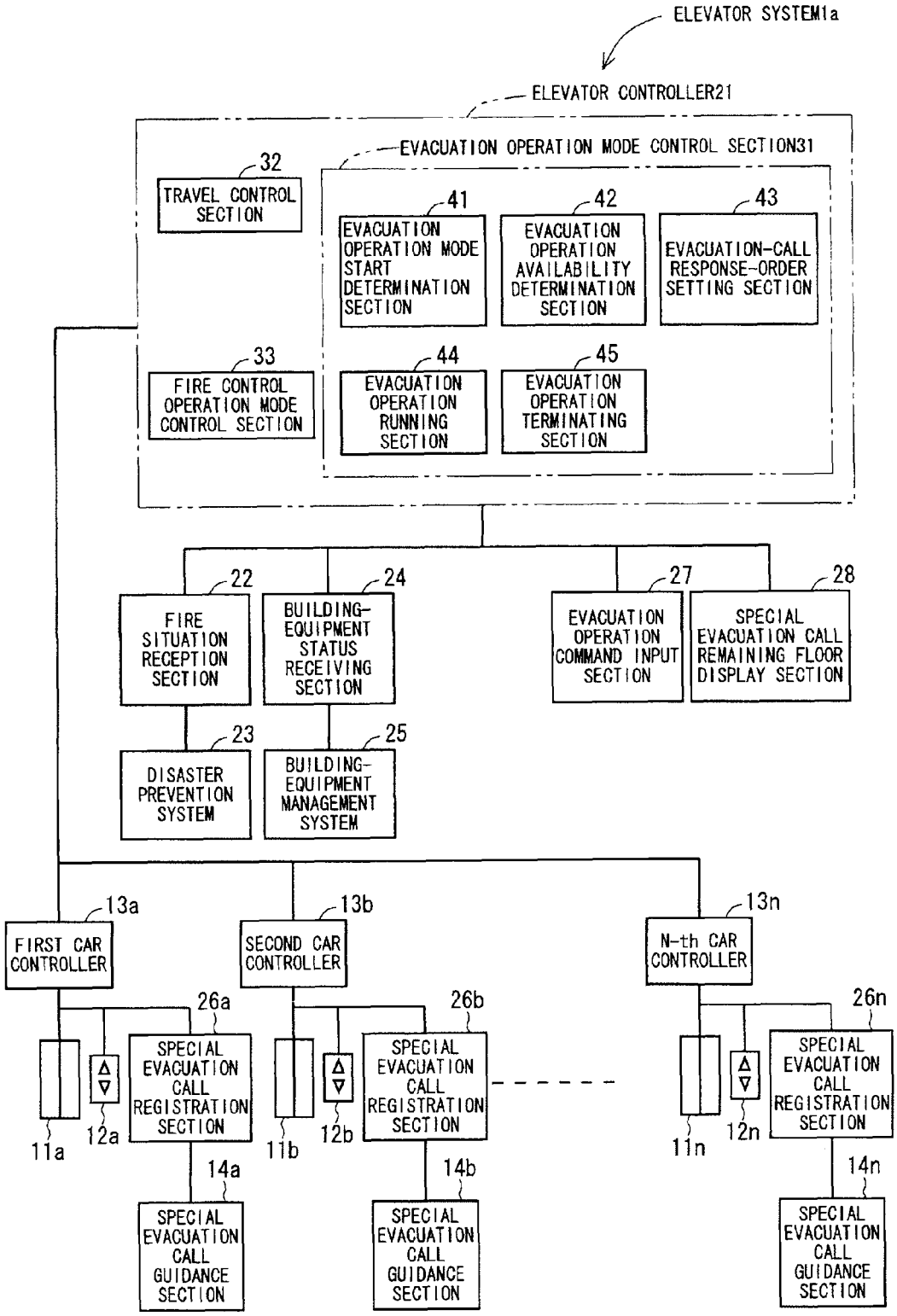
FIG. 7 is a block diagram showing a configuration of an elevator system 1*a* according to an embodiment 2 of the present invention.

FIG. 7 shows a block diagram showing a configuration of an elevator system 1*a* according to this embodiment 2.

In the elevator system 1*a* shown in FIG. 7, evacuation special call guidance sections 14*a*, 14*b*, . . . , 14*n* are arranged for the evacuation special call registration sections 26*a*, 26*b*, 26*n* of the elevator system shown in FIG. 2, respectively. For example, the evacuation special call guidance sections 14*a*, 14*b*, . . . , 14*n* are arranged in the respective halls.

In the elevator system 1*a* shown in FIG. 7, it is assumed that the cars 11*a*, 11*b*, . . . , 11*n* having been stopped in response to the evacuation special call is started. In this system 1*a*, during a certain time period after the start, the evacuation special call guidance section 14*a*, 14*b*, . . . , 14*n* give a guidance to passengers (users) in the respective halls so as to perform a call registration operation again while continuing the evacuation special call registration in the floor. The passengers given the guidance can perform the call registration operation again on the evacuation special call registration sections 26*a*, 26*b*, . . . , 26*n*. In a possible configuration, the call is canceled if the call registration operation is not performed again.

It is assumed that an evacuation special call is canceled immediately after the call is responded to in a certain floor, and the cars 11*a*, 11*b*, . . . 11*n* respond to another floor having a lower priority, and then an evacuation special call is registered in the certain floor again. In this case, chattering occurs in the selection of the responding floor.

Therefore, as in the elevator system 1*a*, the evacuation special call guidance sections 14*a*, 14*b*, . . . , 14*n* are provided to thereby avoid chattering in the selection of the responding floor.

The elevator system 1*a* may be configured as follows. In a case where the fire does not progress to an evacuation special call remaining floor, it is determined that the evacuation operation is not available, and then the evacuation special call guidance sections 14*a*, 14*b*, . . . , 14*n* give a guidance encouraging a call registration operation to be performed again, for a certain time period. Furthermore, the system 1*a* is configured so as to cancel the evacuation special call and so as not to output the remaining floor information regarding this floor in a case where the evacuation special call registration operation is not performed again even after the certain time period elapses. Such a configuration of the elevator system 1*a* enables the floor in which evacuees are left in the hall to be surely outputted as the remaining floor information.

Needless to say, the elevator system 1*a* according to this embodiment also exerts the same effects as those of the elevator system according to the embodiment 1.

Embodiment 3

In a case where the evacuation special call registration sections 26*a* to 26*n* register the evacuation special call through the residence intercom, the IC (Integrated Circuit) tag reader, the key tag reader, the fingerprint authentication device, the face recognition authentication device, or the like, the elevator system 1*a* according to the embodiment 2 may be configured as follows.

The elevator system 1*a* is configured such that a person (the former) who absolutely cannot use stairs, such as a person with a stretcher, a wheelchair, or the like, can be distinguished from a person (the latter) who can use the stairs for a short distance, such as an elderly person, a parent with a baby, or the like. The elevator system 1*a* is also configured to calculate a time period required for evacuation. The elevator system 1*a* is configured such that, in a case where the time period required for evacuation is longer than a time period left before the fire progresses to this floor, the evacuation special call registration is not performed with respect to the latter and a guidance for walking to a lower-priority floor is given to the latter. The elevator system 1*a* is also configured such that a guidance indicating the availability of the elevator at that floor is given to the former so that an evacuation special call can be registered by the former.

Figure 8:
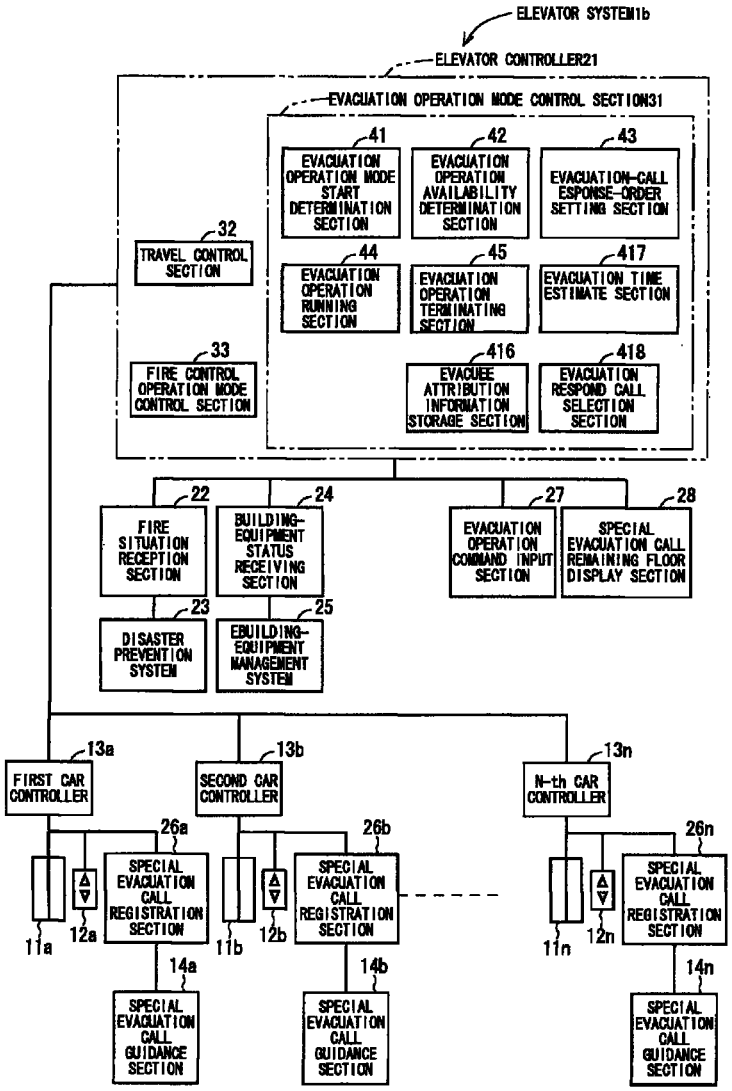
FIG. 8 is a block diagram showing a configuration of an elevator system 1*b* according to an embodiment 3 of the present invention.

A specific embodiment of such a configuration is an elevator system 1*b* according to this embodiment 3. FIG. 8 is a block diagram showing a configuration of the elevator system 1*b*.

The elevator system 1*b* shown in FIG. 8 is identical to the elevator system 1*a*, except that an evacuee attribution information storage section 416, an evacuation time estimate section 417, and an evacuation response call selection section 418 are additionally provided in the evacuation operation mode control section 31.

The evacuee attribution information storage section 416 stores an ID and evacuee attribute information in association with each other. The ID and the evacuee attribute information are obtained when an evacuee performs an evacuation special call registration operation on the evacuation special call registration sections 26*a*, 26*b*, . . . , 26*n*. Specific examples of the attribute information include information of whether or not stairs can be used, information of whether or not the evacuee is an elderly person, information of whether or not the evacuee is a baby, information of whether or not the evacuee uses a stretcher, information of whether or not the evacuee uses a wheelchair, and the like.

The evacuation time estimate section 417 responds to all evacuation special calls of a certain floor, and estimates, for each floor, an evacuation completion time period required before everyone is evacuated. There, the estimation is performed using the number of registered evacuation special calls, the evacuee attribute information that is obtained from the evacuee attribution information storage section 416 based on the IDs of the corresponding evacuation special calls, and information of the capacity, the speed, the floor height of the elevator that has been set in advance.

The evacuation response call selection section 418 predicts a fire progress time period required before the fire progresses to the elevator hall, based on the information given from the fire situation reception section 22 and a fire-resistant time of the building that has been set in advance.

The evacuation response call selection section 418 compares, for each floor, the predicted fire progress time period with the evacuation completion time period obtained by the evacuation time estimate section 417.

If there is a predetermined floor in which the evacuation completion time period is longer than the fire progress time period, the evacuation response call selection section 418 selects a lower-priority floor closest to this predetermined floor.

Through the evacuation special call guidance sections 14*a*, 14*b*, . . . , 14*n* installed in the predetermined floor, the evacuation response call selection section 418 gives the evacuee (the latter) who can use the stairs a guidance for evacuating to the selected floor (the closest lower-priority floor) using the stairs. On the other hand, through the evacuation special call guidance section 14*a*, 14*b*, . . . , 14*n*, the evacuation response call selection section 418 gives the former a guidance indicating the availability of the elevator at that floor.

The determination of distinction between the former and the latter is obtained when the evacuation special call registration operation is performed. The evacuation response call selection section 418 performs the operation by using the attribute information stored in the evacuee attribution information storage section 416.

In a case where the attribute information of any evacuation special call registration person in the floor indicates that the stairs can be used, the call registration is canceled.

Adoption of the elevator system 1*b* according to this embodiment enables the distinction between the former and the latter so that an appropriate guidance can be given to the former and an appropriate guidance can be given to the latter.

Needless to say, the elevator system 1*a* according to this embodiment also exerts the same effects as those of the elevator system according to the embodiment 1.

Embodiment 4

The elevator system shown in FIG. 2 may be configured as follows. The evacuation special call registration sections 26*a*, 26*b*, 26*n* have a function of inputting the number of persons in the hall who are prepared to ride and the number of wheelchairs and stretchers, or a function of sensing the number of persons who are prepared to ride, the wheelchairs, and the stretchers based on a camera image. Only when there is a room in the cars 11*a*, 11*b*, . . . , 11*n*, a response is made to the highest-priority floor located between the evacuation special call floor and the evacuation floor, after the departure from the evacuation special call floor. Here, to be more specific, the highest-priority floor means the highest-priority floor among the remaining evacuation special call floors in which the number of waiting persons is smaller than the room in the cars 11*a*, 11*b*, 11*n*. When there is no room in the cars 11*a*, 11*b*, . . . , 11*n*, the cars 11*a*, 11*b*, 11*n* are directly moved between the call responding floor and the evacuation floor.

Figure 9:
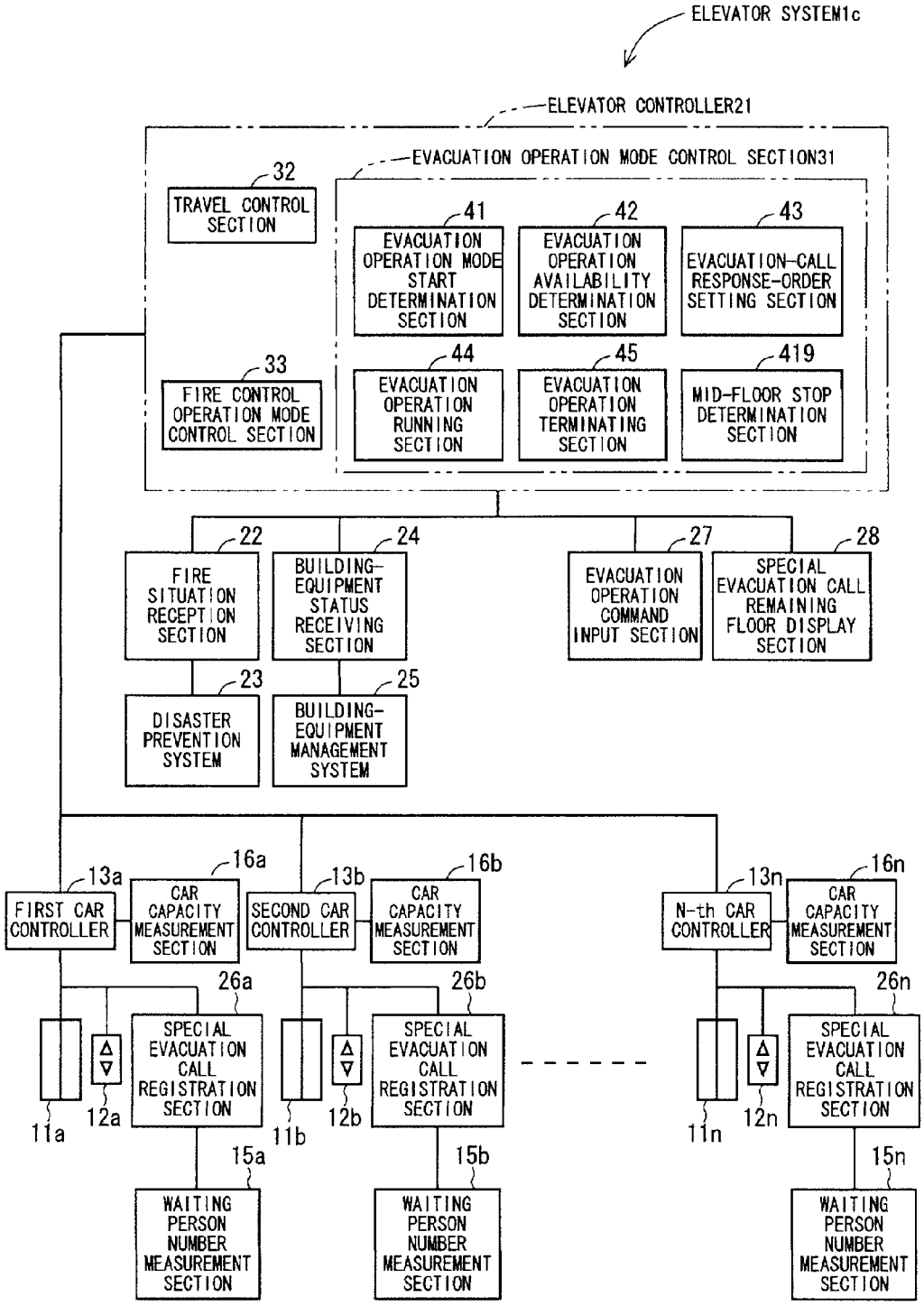
FIG. 9 is a block diagram showing a configuration of an elevator system 1*c* according to an embodiment 4 of the present invention.

A specific embodiment of such a configuration is an elevator system 1*c* according to this embodiment 4. FIG. 9 is a block diagram showing a configuration of the elevator system 1*c*.

As shown in FIG. 9, the elevator system 1*c* is identical to the elevator system shown in FIG. 2, except that a mid-floor stop determination section 419 is additionally provided in the evacuation operation mode control section 31. Moreover, in the elevator system 1*c*, unlike the elevator system shown in FIG. 2, waiting person number measurement sections 15*a*, 15*b*, . . . , 15*n* are arranged for the evacuation special call registration sections 26*a*, 26*b*, 26*c*, respectively, and car capacity measurement sections 16*a*, 16*b*, . . . , 16*n* are arranged for the car control controllers 13*a*, 13*b*, . . . , 13*n*, respectively.

The waiting person number measurement sections 15*a*, 15*b*, . . . , 15*n* are means for measuring, for each floor, the number of users prepared to ride and the number of waiting wheelchairs and stretchers. The waiting person number measurement sections 15*a*, 15*b*, . . . , 15*n* may be operation panels to which a passenger (user) having registered the evacuation special call inputs the number of persons prepared to ride or the number of waiting wheelchairs and stretchers. The waiting person number measurement sections 15*a*, 15*b*, . . . , 15*n* may also be devices that measure the number of waiting persons or the number of waiting wheelchairs and stretchers based on a camera image or the like.

The car capacity measurement sections 16*a*, 16*b*, . . . , 16*n* are means for measuring the degree of crowding within the cars 11*a*, 11*b*, 11*n*, respectively. The car capacity measurement sections 16*a*, 16*b*, . . . , 16*n* may perform calculation based on values of balance devices that are normally equipped in the cars 11*a*, 11*b*, 11*n*, respectively. Cameras or the like may be installed in the respective cars 11*a*, 11*b*, . . . ,

11*n* so that the car capacity measurement sections 16*a*. 16*b*, . . . , 16*n* measure the degree of crowding based on information obtained by these cameras.

After the cars 11*a* to 11*n* depart in response to the evacuation special call, the mid-floor stop determination section 419 stops the cars 11*a*, 11*b*, . . . , 11*n* at the following floor, by using the number of waiting persons measured by the waiting person number measurement sections 15*a*, 15*b*, . . . , 15*n* and the degree of crowding measured by the car capacity measurement sections 16*a*, 16*b*, . . . , 16*n*.

More specifically, the mid-floor stop determination section 419 sequentially selects high-priority floors from the remaining evacuation special call floors located between a departure floor and the evacuation floor (first selection). The mid-floor stop determination section 419 also selects a floor in which there are passengers capable of riding on the cars 11*a* to 11*n*, based on the number of waiting persons and the degree of crowding (second selection). Then, the mid-floor stop determination section 419 stops the cars 11*a*, 11*b*, . . . , 11*n* at, among the result of the first selection, the highest-priority floor that is the floor selected in the second selection. That is, the mid-floor stop determination section 419 stops the cars 11*a*, 11*b*, . . . , 11*n* at the highest-priority floor among the floors in which there are passengers capable of riding.

For example, in a case where there are only waiting persons with wheelchairs and stretchers, and additionally the cars 11*a*, 11*b*, . . . , 11*n* have no room for embarking these waiting persons; the mid-floor stop determination section 419 determines that the cars 11*a*, 11*b*, . . . , 11*n* are not to be stopped at the floor in which these waiting persons exist.

In a case where there are waiting persons who will not occupy a large space in the cars 11*a*, 11*b*, . . . , 11*n*, such as an elderly person and a parent with a baby, and additionally the cars 11*a*, 11*b*, 11*n* have a room for embarking these waiting persons; the mid-floor stop determination section 419 determines that the cars 11*a*, 11*b*, . . . , 11*n* are to be stopped at the floor in which there are these waiting persons.

Adoption of the elevator system 1*c* according to this embodiment can increase an evacuation efficiency as compared with a case where only a single evacuation special call floor is responded to. Furthermore, since the cars are allocated in the priority order, waiting person's concerns that the parson cannot ride on the cars 11*a*, 11*b*, 11*n* are prevented.

Needless to say, the elevator system 1*a* according to this embodiment also exerts the same effects as those of the elevator system according to the embodiment 1.

DESCRIPTION OF THE REFERENCE NUMERALS

1, 1*a*, 1*b*, 1*c* elevator system; 11*a* to 11*n* car; 12*a* to 12*n* hall call button; 13*a* to 13*n* first to N-th car controller; 14*a* to 14*n* evacuation special call guidance section; 16*a* to 16*n* car capacity measurement section; 15*a* to 15*n* waiting person measurement section; 21 elevator controller; 22 fire situation reception section; 23 disaster prevention system; 24 building-equipment status receiving section; 25 building-equipment management system; 26, 26*a* to 26*n* evacuation special call registration section; 27 evacuation operation command input section; 28 evacuation special call remaining floor display section; 31 evacuation operation mode control section; 32 travel control section; 33 fire control operation mode control section; 41 evacuation operation mode start determination section; 42 evacuation operation availability determination section; 43 evacuation-call response-order setting section; 44 evacuation operation running section; 45 evacuation operation terminating section; 416 evacuee attribution information storage section; 417 evacuation time estimate section; 418 evacuation response call selection section; 419 mid-floor stop determination section.

The invention claimed is:

1. An elevator system controlling an elevator so as to perform an evacuation operation for evacuating a user in case of a fire, said elevator system comprising:

an evacuation-call response-order setting section for: setting, based on fire occurrence information including a site of occurrence of the fire, a priority order of a response to an evacuation special call that is a special hall call for the evacuation operation registered by the user; and selecting, based on said priority order, a call responding floor to be responded to from registration floors in which said evacuation special call is registered; and an evacuation operation running section for controlling an operation of the elevator so as to direct the elevator to said call responding floor selected by said evacuation-call response-order setting section, wherein in a case that said evacuation special call given a higher priority than said evacuation special call registered in said selected call responding floor is newly registered before said elevator arrives at said call responding floor, said evacuation-call response-order setting section changes said call responding floor to a floor in which said evacuation special call is newly registered.

2. The elevator system according to claim 1, wherein said evacuation-call response-order setting section sets the priority order of the response to said evacuation special call on a zone basis, said zone being obtained as a result of classifying all floors to which the elevator is movable into a plurality of zones such that at least one of said zones include a plurality of floors.

3. The elevator system according to claim 2, wherein said evacuation-call response-order setting section sets said priority order such that the highest-priority zone among said plurality of zones include a fire occurring floor in which the fire is occurring.

4. The elevator system according to claim 3, wherein said evacuation-call response-order setting section sets said priority order such that the second highest-priority zone among said plurality of zones include an immediately-above-fire floor that is a floor immediately above the fire occurring floor.

5. The elevator system according to claim 1, wherein said evacuation-call response-order setting section sets said priority order such that, among all the floors of the building equipped with the elevator, the fire occurring floor in which the fire is occurring and a floor above the fire occurring floor are given a higher priority than a floor below said fire occurring floor.

6. The elevator system according to claim 1, further comprising:

an evacuation operation availability determination section for determining the availability of the evacuation operation based on said fire occurrence information; and a remaining floor output section for, in a case where said evacuation operation availability determination section determines that the evacuation operation is not available, outputting remaining floor information indicating a remaining evacuation special call registration floor.

7. The elevator system according to claim 6, wherein said remaining floor output section outputs said remaining floor information to display means, and said display means displays said remaining evacuation special call registration floor.

8. The elevator system according to claim 1, further comprising an evacuation special call guidance section for giving said user in each hall a guidance for performing a call registration operation again.

9. The elevator system according to claim 1, further comprising an evacuation response call selection section for: comparing, with respect to each floor, a fire progress time period predicted for each floor with an evacuation completion time period measured for each floor; and in a case that there is a predetermined floor in which said evacuation completion time period is longer than said fire progress time period, selecting said predetermined floor that is closest and has a lower priority.

10. The elevator system according to claim 1, further comprising:

a waiting person number measurement section for measuring the number of waiting users in each floor;

a car capacity measurement section for measuring the degree of crowding in a car; and a mid-floor stop determination section for, based on said number of waiting users and said degree of crowding, stopping said car at the highest-priority floor among floors in which there are users capable of riding.

11. An elevator system controlling an elevator so as to perform an evacuation operation for evacuating a user in case of a fire, said elevator system comprising:

an evacuation operation availability determination section for determining the availability of the evacuation operation based on fire occurrence information including a site of occurrence of the fire; and a remaining floor output section for, in a case that said evacuation operation availability determination section determines that the evacuation operation is not available, outputting remaining floor information indicating a remaining evacuation special call registration floor among registration floors in which an evacuation special call that is a special hall call for the evacuation operation is registered by the user.

12. The elevator system according to claim 11, wherein said remaining floor output section outputs said remaining floor information to display means, and said display means displays said remaining evacuation special call registration floor.

13. The elevator system according to claim 11, wherein said remaining floor output section outputs said remaining floor information to transmission means that transmits said remaining floor information to outside of said remaining floor output section.

14. The elevator system according to claim 11, further comprising an evacuation special call guidance section for giving said user in each hall a guidance for performing a call registration operation again.

15. The elevator system according to claim 11, further comprising an evacuation response call selection section for: comparing, with respect to each floor, a fire progress time period predicted for each floor with an evacuation completion time period measured for each floor; and in a case where there is a predetermined floor in which said evacuation completion time period is longer than said fire progress time period, selecting said predetermined floor that is closest and has a lower priority.

16. The elevator system according to claim 11, a waiting person number measurement section for measuring the number of waiting users in each floor;

a car capacity measurement section for measuring the degree of crowding in a car; and a mid-floor stop determination section for, based on said number of waiting users and said degree of crowding, stopping said car at the highest-priority floor among floors in which there are users capable of riding.

* * * * *